US010539133B2

(12) United States Patent
Swartzlander et al.

(10) Patent No.: US 10,539,133 B2
(45) Date of Patent: Jan. 21, 2020

(54) TWIN ROTOR DEVICES WITH INTERNAL CLEARANCES REDUCED BY A COATING AFTER ASSEMBLY, A COATING SYSTEM, AND METHODS

(71) Applicant: Eaton Intelligent Power Limited, Dublin (IE)

(72) Inventors: Matthew Gareld Swartzlander, Battle Creek, MI (US); Michael John Froehlich, Marshall, MI (US); Timothy Michael Kish, Kalamazoo, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 15/323,495

(22) PCT Filed: Jul. 1, 2015

(86) PCT No.: PCT/US2015/038789

§ 371 (c)(1),
(2) Date: Jan. 3, 2017

(87) PCT Pub. No.: WO2016/004179

PCT Pub. Date: Jan. 7, 2016

(65) Prior Publication Data

US 2017/0146012 A1 May 25, 2017

Related U.S. Application Data

(60) Provisional application No. 62/020,494, filed on Jul. 3, 2014.

(51) Int. Cl.
*B05D 7/22* (2006.01)
*F04C 2/16* (2006.01)
(Continued)

(52) U.S. Cl.
CPC ..... *F04C 2/16* (2013.01); *B05D 5/005* (2013.01); *B05D 7/22* (2013.01); *F02B 33/38* (2013.01);
(Continued)

(58) Field of Classification Search
CPC . B05D 7/22; B05D 5/005; F04C 2/126; F04C 2/16; F04C 15/06; F04C 18/126;
(Continued)

(56) References Cited

U.S. PATENT DOCUMENTS 4,828,467 A 5/1989 Brown
6,506,037 B1 * 1/2003 Bush ..... F01O 1/16 418/152

(Continued)

FOREIGN PATENT DOCUMENTS

JP 06-170862 A 6/1994
JP 10-299676 A 11/1998

(Continued)

OTHER PUBLICATIONS

JPO machine translation of JP 10-299676 A, published Nov. 1998. (Year: 1998).*

(Continued)

*Primary Examiner* — Kirsten Jolley
(74) *Attorney, Agent, or Firm* — Merchant & Gould P.C.

(57) ABSTRACT

A method of treating, tuning, assembling, and/or overhauling a twin rotor device (200, 1200) includes applying a coating material (102) on an internal set of working surfaces (218, 222, 224, 226, 228, 1218, 1222, 1224, 1226, 1228) of the twin rotor device when at least partially assembled. The coating may be factory or field applied to a new or used twin rotor device. The working surfaces may be uncoated or previously coated and may be built-up as the coating material forms a coating (206, 1206) on at least some of the
(Continued)

working surfaces. Manufacturing variations of a pair of rotors (220, 1220) and a housing (210, 1210) may be compensated by the coating. One or more performance characteristics of the twin rotor device may be improved by the coating, and variation between a series of twin rotor device may be reduced or substantially eliminated. The coating may reduce internal leakage and increase volumetric efficiency of the twin rotor device. The twin rotor device may be a supercharger 200, a screw compressor 1200, or other twin rotor device.

18 Claims, 8 Drawing Sheets

(51) Int. Cl.

| | |
|---|---|
| ***F04C 18/12*** | (2006.01) |
| ***F04C 18/16*** | (2006.01) |
| ***B05D 5/00*** | (2006.01) |
| ***F02B 33/38*** | (2006.01) |
| ***F04C 2/12*** | (2006.01) |
| ***F04C 15/06*** | (2006.01) |
| ***F04C 29/12*** | (2006.01) |

(52) U.S. Cl.
CPC ..... *F04C 2/126* (2013.01); *F04C 15/06* (2013.01); *F04C 18/126* (2013.01); *F04C 18/16* (2013.01); *F04C 29/12* (2013.01); *F04C 2230/60* (2013.01); *F04C 2230/91* (2013.01); *F04C 2240/30* (2013.01)

(58) Field of Classification Search
CPC .... F04C 18/16; F04C 29/12; F04C 2230/602; F04C 2230/91; F02B 33/38
USPC ..... 427/230, 235, 239
See application file for complete search history.

(56) References Cited

U.S. PATENT DOCUMENTS

| | | | | |
|---|---|---|---|---|
| 7,866,966 | B2 | 1/2011 | Swartzlander | |
| 2002/0127332 | A1* | 9/2002 | Bertellotti | B05B 5/12 427/233 |
| 2003/0126733 | A1* | 7/2003 | Bush | B05D 3/12 29/458 |
| 2007/0259116 | A1* | 11/2007 | Nolan | B05D 1/32 427/282 |
| 2008/0292486 | A1 | 11/2008 | Ouwenga | |

FOREIGN PATENT DOCUMENTS

| | | | |
|---|---|---|---|
| JP | 2002-213381 | A | 7/2002 |
| WO | 2013/137266 | A1 | 9/2013 |

OTHER PUBLICATIONS

International Search Report and Written Opinion of the International Searching Authority for corresponding International Patent Application No. PCT/US2015/038789 dated Sep. 25, 2015, 14 pgs.

* cited by examiner

FIG. 4
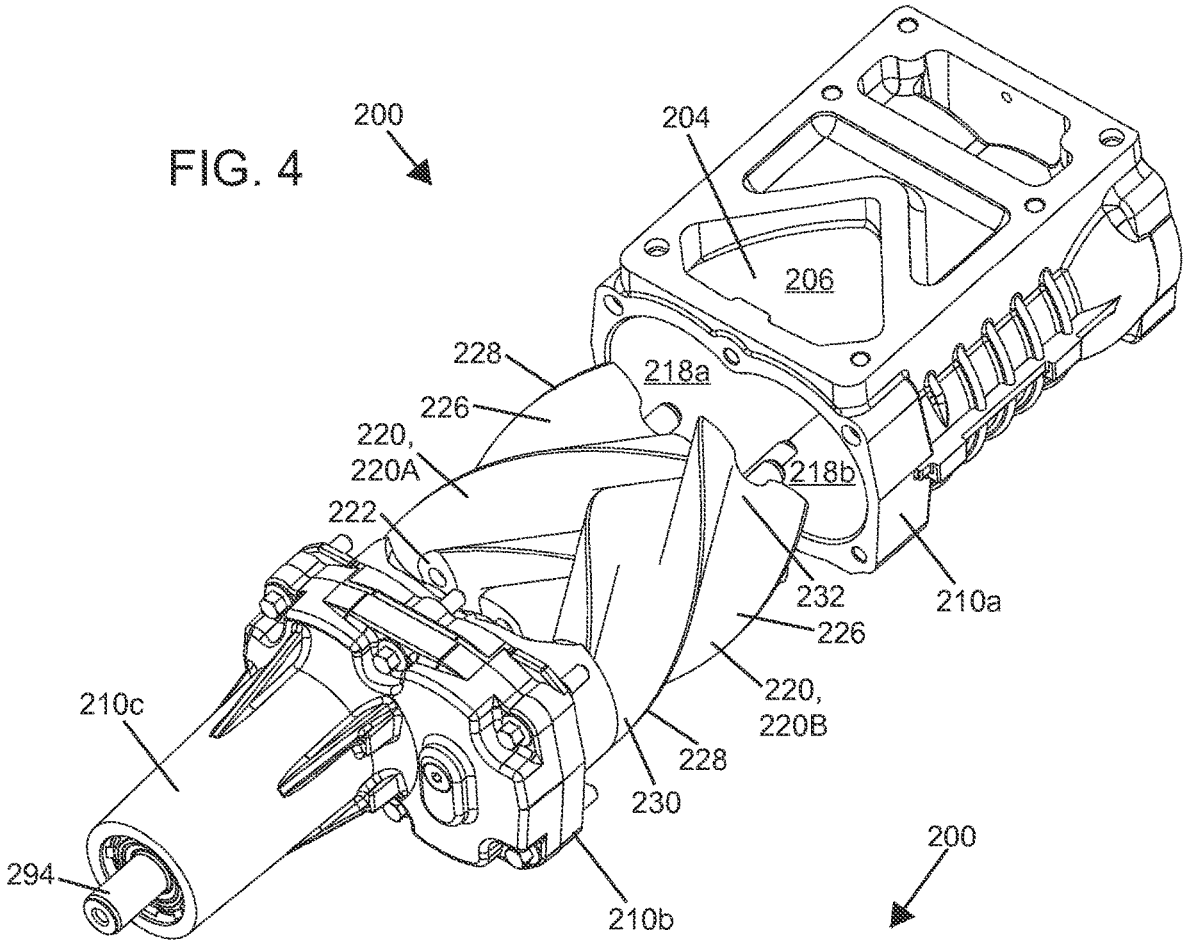
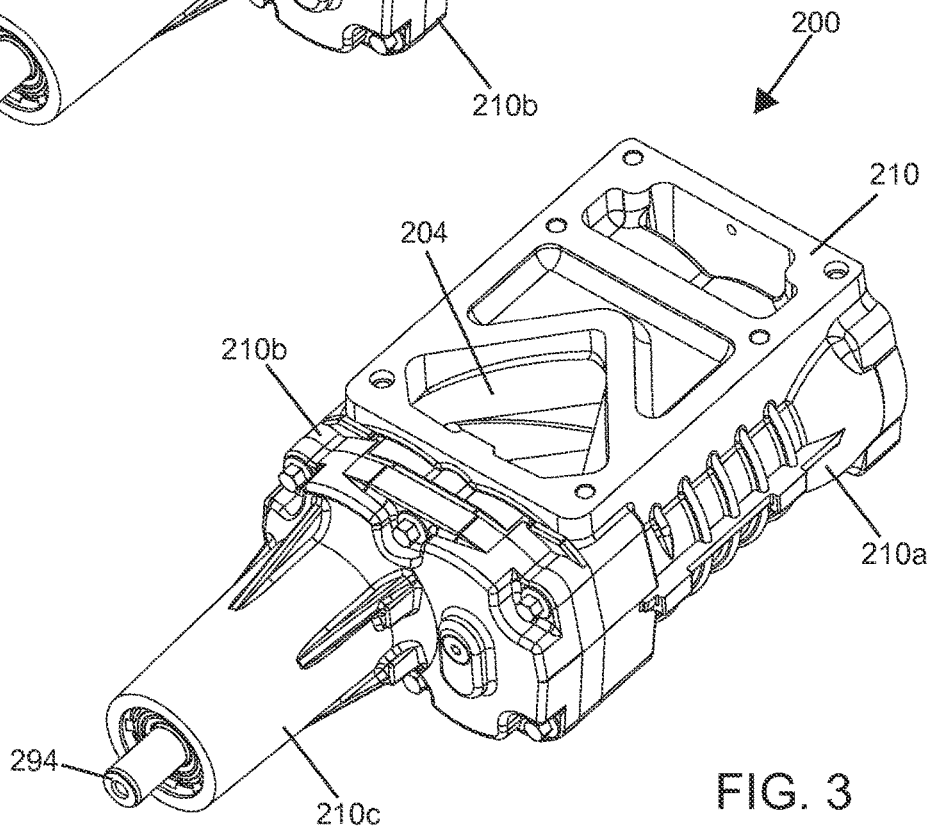
FIG. 3

TWIN ROTOR DEVICES WITH INTERNAL CLEARANCES REDUCED BY A COATING AFTER ASSEMBLY, A COATING SYSTEM, AND METHODS

CROSS-REFERENCE TO RELATED APPLICATION(S)

This application is a U.S. National Stage Application of PCT/US2015/038789, filed on Jul. 1, 2015, which claims benefit of U.S. Patent Application Ser. No. 62/020,494 filed on Jul. 3, 2014, and which applications are incorporated herein by reference. To the extent appropriate, a claim of priority is made to each of the above disclosed applications.

TECHNICAL FIELD

The present disclosure relates to twin rotor devices (e.g., Roots-style superchargers, Roots-style expanders, screw compressors, screw expanders, etc.). Such twin rotor devices can be used to pump and/or compress fluids (e.g., gasses, air, mixtures, etc.) using shaft power and/or can be used to extract shaft power from fluids (e.g., by expanding compressed gas).

BACKGROUND

The present invention relates to twin rotor blowers/compressors, twin rotor expanders, etc. Such twin rotor blowers/compressors have been used for supercharging internal combustion engines (e.g., Diesel cycle engines, Otto cycle engines, etc.). When used on internal combustion engines, such twin rotor blowers/compressors may be a component of a forced induction system that supplies air or an air/fuel mixture to the internal combustion engine. Such forced induction systems supply the internal combustion engine with the air or the air/fuel mixture at a higher pressure than atmospheric pressure. In contrast, naturally aspirated internal combustion engines are supplied with air or an air/fuel mixture at atmospheric pressure. By supplying pressurized air or a pressurized air/fuel mixture to the internal combustion engine, the engine is supercharged. The twin rotor blowers/compressors may be known as positive displacement superchargers. Such positive displacement superchargers displace a given volume of gas for every revolution of an input shaft at a given pressure and a given temperature. In contrast, certain other superchargers may be non-positive displacement superchargers.

The twin rotor blowers/compressors may take a form of a Roots-type device, a form of a screw compressor, etc. The Roots-type device may have a pair of rotors that intermesh with each other. In particular, each of the rotors may define a similar plurality of lobes with valleys between adjacent lobes. The lobes and valleys of the pair of rotors may be mirror images of each other (e.g., if helically twisted). The lobes and valleys of the pair of rotors may be identical to each other (e.g., if straight along an axial direction of the rotor). The lobes and valleys may be defined by alternating tangential sections of hypocycloidal or hypocycloidal-like curves and epicycloidal or epicycloidal-like curves. When each of the pair of rotors is spun, fluid is trapped in the valleys and bounded by the adjacent lobes and walls of a housing and carried from an intake side to an exhaust side of the Roots-type device. The twin rotor blowers/compressors (e.g., the Roots-type device) may move the fluid from the intake side to the exhaust side without compression until the fluid is exposed to the exhaust side (e.g., an exhaust port). As the fluid is forced out of the exhaust port, it may be compressed.

The screw compressor (e.g., a twin-screw type supercharger) may have a pair of rotors that intermesh with each other. In particular, the pair of rotors may include a male rotor and a female rotor that intermesh with each other. The male rotor and the female rotor may have different numbers of lobes or a same number of lobes. A working volume may be defined as an inter-lobe volume between the male and the female rotors. When each of the pair of rotors is spun, fluid is trapped in the working volume bounded by the adjacent lobes and walls of a housing and carried from an intake end to an exhaust end of the screw compressor. The working volume may be larger at the intake end. The working volume may decrease along an axial length of the rotors toward the exhaust end. Fluid is drawn in at the intake end of the rotors between the male and female lobes. A corresponding reduction in the working volume toward the exhaust end may result in compression of the fluid that is trapped in the working volume. For example, at the intake end, the male lobes of the male rotor (and corresponding valleys of the female rotors) may be larger than corresponding female lobes of the female rotor (and corresponding valleys of the male rotors), and at the exhaust end, the male lobes (and corresponding valleys of the female rotors) may be smaller than corresponding female lobes (and corresponding valleys of the male rotors). Thus, relative sizes of the male and female lobes may reverse proportions along axial lengths of both of the rotors (e.g., the male lobes become larger and the female lobes become smaller). The increase in volume of the female lobes may result in a reduction in volume of the fluid carrying cavity and thereby cause the compression of the fluid before the fluid carrying cavity is in fluid communication with the exhaust end.

Other methods of reducing the working volume toward the exhaust end may be used. In certain embodiments, a screw-compressor like device may not necessarily reduce the working volume toward the exhaust end.

An example Roots-style supercharger is disclosed at U.S. Pat. No. 7,866,966, assigned to the assignee of the present disclosure, and incorporated herein by reference in its entirety. Another example Roots-style supercharger is disclosed at U.S. Pat. No. 4,828,467, also assigned to the assignee of the present disclosure, and also incorporated herein by reference in its entirety. As such Roots-style superchargers (and other twin rotor superchargers) typically draw air in through an inlet at atmospheric pressure and deliver compressed air from an outlet to an intake manifold of the internal combustion engine at an elevated pressure, the elevated pressure from the outlet of the Roots-style supercharger (and other twin rotor superchargers) typically tends to leak back across clearances within the supercharger. Such clearances may be between lobes of a pair of rotors within the supercharger. Clearances may also exist between tips of the lobes of the rotors and a housing of the supercharger. Clearances may further exist between an end of the rotors of the supercharger and corresponding surfaces of the housing. Such clearances are often determined, at least in part, by manufacturing tolerances of the rotors and the housing of the supercharger. For example, a Roots-style supercharger made with a collection of components at a minimum material condition with respect to the manufacturing tolerances will have leakage rates higher than another Roots-style supercharger assembled from components at a maximum material condition with respect to the manufacturing tolerances. This may lead to certain Roots-style superchargers that are nominally identical having different performance characteristics that are caused by the different leakage rates. Furthermore, it is generally desired to reduce such clearances and thereby minimize leakage within the supercharger. However, increasing precision of the manufacturing tolerances may increase manufacturing costs. Furthermore, a number of different dimensions and corresponding dimensional tolerances together determine the clearances that exist at final assembly. It is desired to reduce the leakage rate within a supercharger (and other twin rotor devices) without depending upon high precision dimensional tolerances from the set of individual components in the assembled supercharger and/or twin rotor device.

Typical screw compressors have similar leakage issues caused by clearances between lobes of the pair of rotors, clearances between tips of the lobes of the rotors and a housing, and clearances between an end of the rotors and corresponding surfaces of the housing. Likewise, increasing precision of the manufacturing tolerances may increase manufacturing costs, and a number of different dimensions and corresponding dimensional tolerances together may determine the clearances that exist at final assembly. It is also desired to reduce the leakage rate within a screw compressor without depending upon high precision dimensional tolerances from the set of individual components in the assembled screw compressor.

When Roots-style superchargers or similar twin rotor devices are run in reverse (i.e., when fluid pressure and flow are converted into shaft power), a Roots-type device (and/or other twin rotor device) may serve as a Roots-style expander (and/or other twin rotor expander). Such expanders may have similar leakage issues caused by clearances between lobes of the pair of rotors, clearances between tips of the lobes of the rotors and a housing, and clearances between an end of the rotors and corresponding surfaces of the housing. It is also desired to reduce the leakage rate within a Roots-style expander without depending upon high precision dimensional tolerances from the set of individual components in the assembled Roots-style expander.

Similarly, when screw compressors or similar devices are run in reverse (i.e., when fluid pressure and flow are converted into shaft power), a screw-type device may serve as a screw expander. Such screw expanders may have similar leakage issues caused by clearances between lobes of the pair of rotors, clearances between tips of the lobes of the rotors and a housing, and clearances between an end of the rotors and corresponding surfaces of the housing. It is also desired to reduce the leakage rate within a screw expander without depending upon high precision dimensional tolerances from the set of individual components in the assembled screw expander.

SUMMARY

An aspect of the present disclosure relates to various improvements made to twin rotor devices (e.g., Roots-style superchargers). The improvements may result from reduced internal clearances between intermeshing lobes of the Roots-style supercharger, between tips of the lobes and corresponding surfaces of a housing of the Roots-style supercharger, and/or from reduced clearances between ends of the rotors and corresponding surfaces of the housing. In particular, the twin rotor device may be partially or fully assembled and a coating (e.g., an abradable coating) may be applied to the assembled or partially assembled twin rotor device. If partially assembled, the pair of rotors and the housing may be sub-assembled. The rotors may be rotating as the coating is applied and/or as the coating is curing. The rotors may be driven by an input shaft of the twin rotor device and/or may be driven by a pressure differential across an inlet and an outlet of the twin rotor device. The coating may cure and adhere to some or all of the internal surfaces of the twin rotor device.

In embodiments where differential pressure drives the rotors and/or otherwise exists between the inlet and the outlet of the twin rotor device, leakage resulting from internal clearances may draw a coating precursor material as the coating precursor material passes through the twin rotor device. As the coating precursor material is deposited on surfaces defining the internal clearances, a coating is formed on the surfaces defining the internal clearances, and the coating reduces the various clearances, and the leakage is thereby reduced in areas where the coating has been deposited/formed. Other areas with remaining clearances (e.g., larger remaining clearances that result in greater leakage rates) thereby attract the coating precursor material, and the remaining clearances are also reduced as a coating is also formed on the surfaces defining the remaining clearances.

By measuring and monitoring the pressure differential between the inlet and the outlet and/or rotor speed of the rotors, the leakage rate (e.g., an overall internal leakage rate) may be monitored and the coating process may be continued until the internal leakage rate is reduced to a desired level and/or a predetermined level. The internal leakage may be measured by various means that may include measuring the pressure differential with pressure sensors and/or the rotor speed with a tachometer. A series of twin rotor devices from a given assembly line and/or multiple assembly lines across the world can thereby be tuned to have identical or near identical performance characteristics that are independent of the manufacturing variability of the components.

In methods using powder-coating techniques and/or other techniques that require an electrical connection, portions of the housing that cover a gear set of the rotors may be left off during the coating process thereby allowing a grounding brush to contact a shaft of one or both of the rotors to provide an electrical ground and facilitate electrostatic depositing of powder coating material on the rotors (e.g., while the rotors are spinning). The other internal surfaces (e.g., of the housing) may also be grounded to facilitate electrostatic depositing of powder coating material. In certain embodiments, the rotors and the housing may both be grounded. In other embodiments, the rotors and the housing may be oppositely charged. In certain embodiments, the electric charge applied to the rotors and/or the housing may be positive or negative. In other embodiments, the electric charge applied to the rotors and/or the housing may alternate between positive and negative.

The coating may be cured by conventional means. For example, the coating may be cured by evaporation of volatile organic compounds, a chemical reaction of a two-part epoxy, heat, ultraviolet energy, powder-coating curing methods, etc. A catalyst may be applied to the rotors and/or the housing prior to the coating material being applied (e.g., before assembly or sub-assembly). The catalyst may facilitate curing of the coating on the rotors and/or the housing. The rotors and/or the housing may be coated or partially coated (e.g., before assembly or sub-assembly) before a final coating is applied on the assembled or sub-assembled twin rotor device. In certain embodiments, a dry low flash point solvent may be used to carry the coating. The coating and/or the solvent may be entrained in a fluid flow (e.g., an air flow) that is run through the twin rotor device. In certain embodiments, the coating is cured while the rotors are spinning. In certain embodiments, the solvent may evaporate before the coating material touches the surfaces of the rotor and/or the housing. In certain embodiments, multiple layers of the coating may be deposited (i.e., applied).

Another aspect of the present disclosure relates to improvements in reducing leakage of a twin rotor device. In particular, a method of treating the twin rotor device includes providing an at least partially assembled twin rotor device that includes a pair of rotors and a housing with a first port and a second port. The rotors and the housing define a set of working surfaces. The working surfaces are adapted to interface with each other and thereby interact with gas that passes through the twin rotor device. The method includes inducing a coating material to flow from the first port to the second port of the housing and thereby depositing a coating on the working surfaces. In certain embodiments, the first port is an inlet of the twin rotor device, and the second port is an outlet of the twin rotor device. In other embodiments, the first port is an outlet of the twin rotor device, and the second port is an inlet of the twin rotor device.

The method of applying the coating may include providing a coating material dispenser. The coating material dispenser may be fluidly connected to the first port of the housing. The coating material may be entrained in a carrier fluid by the coating material dispenser. In other embodiments, the second port of the housing is fluidly connected to the coating material dispenser.

In certain embodiments, a torque is applied to at least one of the rotors and thereby spins the rotors and thereby induces the coating material to flow through the twin rotor device. In certain embodiments, a differential pressure may be applied across the first port and the second port of the housing and thereby induce the coating material to flow and further induce the rotors to spin. The differential pressure may be created by applying a suction at one of the ports of the twin rotor device, and/or applying a pressure to the other of the ports of the twin rotor device.

A variety of additional aspects will be set forth in the description that follows. These aspects can relate to individual features and/or to combinations of features. It is to be understood that both the foregoing general description and the following detailed description are exemplary and explanatory only and are not restrictive of the broad concepts upon which the embodiments disclosed herein are based.

BRIEF DESCRIPTION OF THE DRAWINGS

FIG. 3 is a perspective view of the Roots-type device of FIG. 1;

FIG. 4 is the perspective view of FIG. 3, but partially exploded;

DETAILED DESCRIPTION

Reference will now be made in detail to example embodiments of the present disclosure. The accompanying drawings illustrate examples of the present disclosure. When possible, the same reference numbers will be used throughout the drawings to refer to the same or like parts. Since many embodiments of the invention can be made without departing from the spirit and scope of the invention, the invention resides in the claims hereinafter appended.

According to the principles of the present disclosure, clearances may be reduced and thereby internal leakage may be reduced within a twin rotor device (e.g., a Roots-type supercharger, a screw compressor, etc.) by applying a coating to internal surfaces of the twin rotor device after rotors and a housing assembly of the twin rotor device have been assembled together. In certain embodiments, the coating or coatings may be applied at a factory and be part of a finishing process of the twin rotor device. In certain embodiments, the twin rotor device may be refurbished by applying the coatings to a twin rotor device that has already been in service. Such refurbishment may refurbish the coatings of the internal surfaces. In other embodiments, such refurbishment may apply a coating to some or all of the internal surfaces for the first time. Such refurbishment may be combined with other new or refurbished parts (e.g., new seals, new bearings, etc.). Such refurbishment may be done in a factory setting or in a field setting.

Turning now to FIGS. 1-6, a Roots-type supercharger is illustrated according to the principles of the present disclosure. In other embodiments, a Roots-type expander may be subject to the same or similar treatment and/or finishing techniques described herein. As illustrated at FIGS. 1-6, a Roots-type supercharger 200 includes an inlet 202 and an outlet 204. In operation on an internal combustion engine, air is drawn through the inlet 202 and pumped from the inlet 202 to the outlet 204. As a displacement of the supercharger 200 may exceed a displacement of the internal combustion engine, a pressure at the outlet 204 may be greater than a pressure at the inlet 202. The supercharger 200 thereby compresses air or an air-fuel mixture that it delivers to the internal combustion engine. An amount of compression of the air may be referred to as a pressure ratio. In graphs illustrated at FIG. 7, certain tests were conducted at a pressure ratio of 1.4:1.

Figure 1:
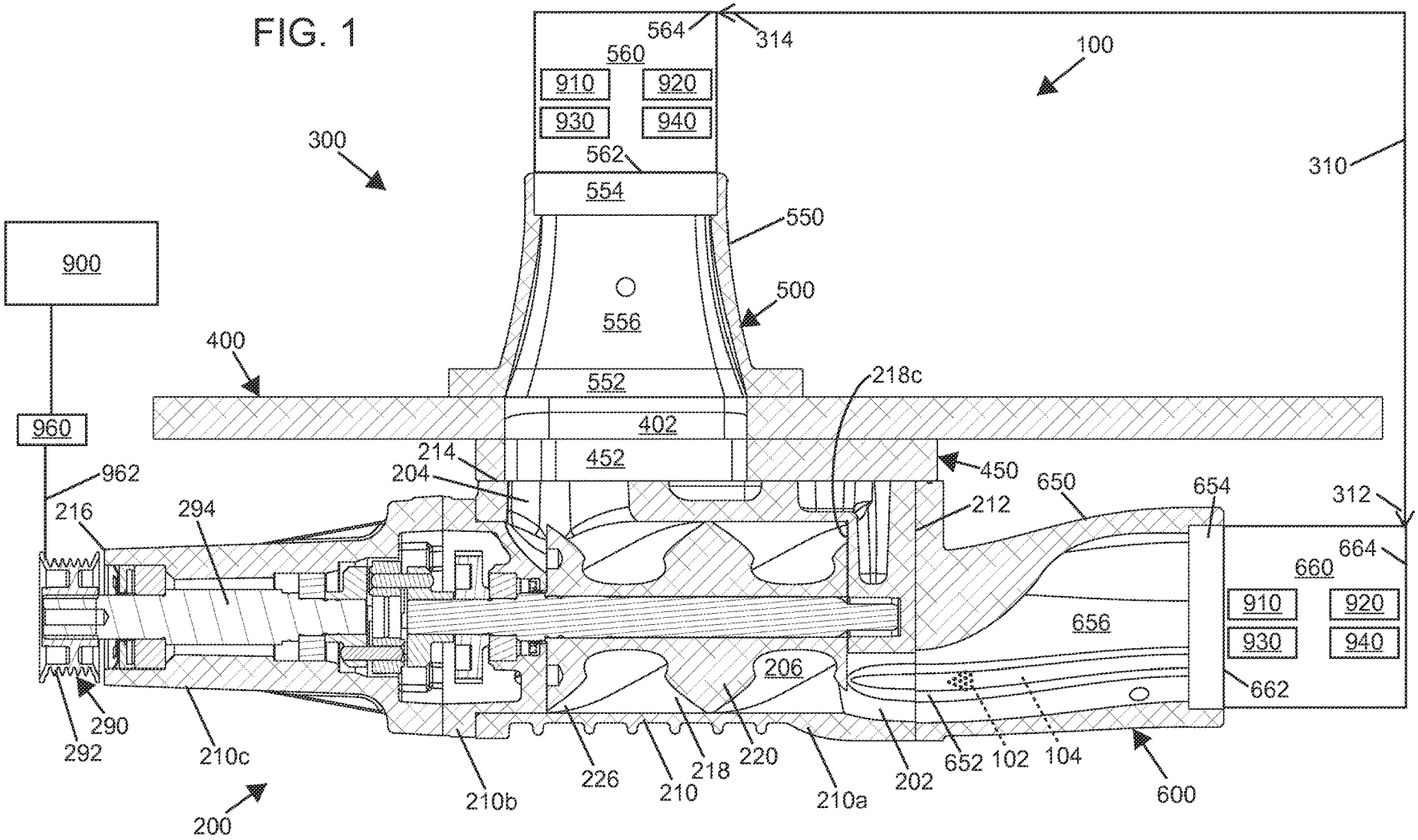
FIG. 1 is a cross-sectional elevation view, including schematic elements, of a Roots-type device and post-assembly coating system according to the principles of the present disclosure, a first portion of the cross-section passes through a center-line of a rotor of the Roots-type device and a second portion of the cross-section passes through a center of an outlet flow handling assembly of the post-assembly coating system.
Figure 2:
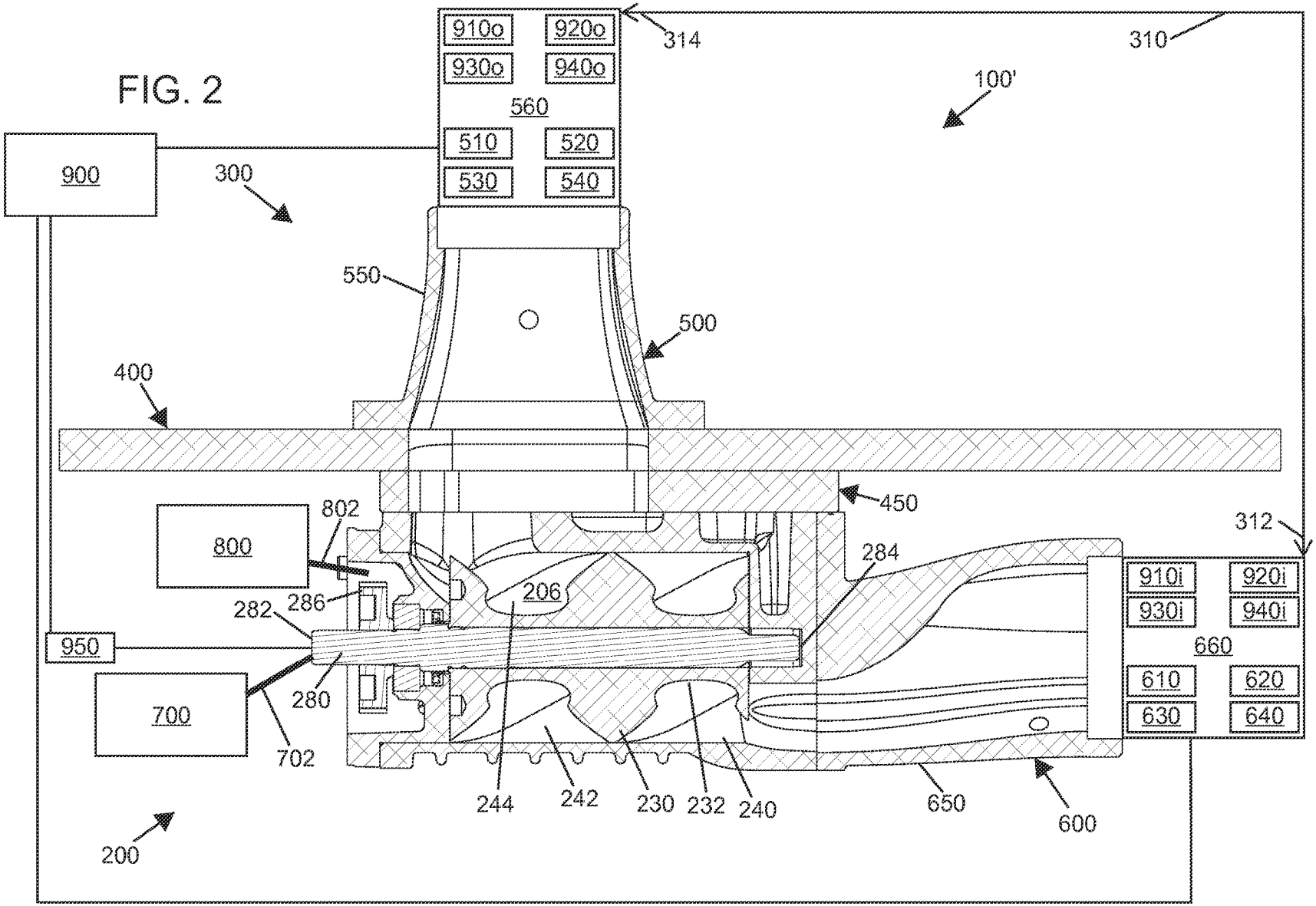
FIG. 2 is the cross-sectional elevation view of FIG. 1, but with additional schematic elements and with a portion of a housing of a shaft drive of the Roots-type device and a portion of the shaft drive of the Roots-type device removed thereby allowing direct electrical and/or mechanical connection to a shaft of the rotor, according to the principles of the present disclosure.

The supercharger 200 further includes a set of rotors 220. The set of rotors 220 includes a first rotor 220A and a second rotor 220B. As illustrated at FIGS. 1, 2, and 4, a drive shaft 294 may coaxially align with a rotor shaft 280 of the rotor 220A. The rotor 220B may be powered by a gear set 286. The rotors 220A, 220B include a plurality of lobes 230 and valleys 232. Each of the lobes 230 further includes a tip 228. As illustrated, the lobes 230 and the valleys 232 extend along a helical path. In other embodiments, the lobes 230 and the valleys 232 may be straight. As depicted, the lobes 230 and the valleys 232 define a screw surface 226. The lobes 230 and the valleys 232 of the rotors 220A, 220B substantially extend between a first end 222 and a second end 224 (see FIGS. 4 and 6).

The supercharger 200 further includes a housing assembly 210. As depicted, the housing assembly 210 includes a main housing 210*a*, an end cap portion 210*b*, and an input power portion 210*c*. The housing assembly 210 defines the inlet 202 and the outlet 204. The housing assembly 210 includes an input end 212 and an output end 214 (see FIG. 1). As depicted, the input end 212 and the output end 214 are substantially perpendicular to each other. In other embodiments, the input end 212 and the output end 214 may be substantially parallel to each other. In still other embodiments, the input end 212 and the output end 214 may be arranged at an angle with respect to each other. As depicted, the housing assembly 210 further includes a drive end 216. As depicted, the rotor shafts 280 generally longitudinally extend between the input end 212 and the drive end 216 of the housing assembly 210.

The housing assembly 210 includes a set of sealing surfaces 218. In the depicted embodiment, the main housing 210*a* of the housing assembly 210 defines sealing surfaces 218*a*, 218*b* of the sealing surfaces 218 that seal with the tips 228 of the rotors 220A, 220B when they are adjacent to each other (see FIGS. 3 and 4). By sealing with each other, as used herein, it is understood that running clearances may exist between the sealing surfaces 218*a*, 218*b* and the tips 228, and that leakage may occur between the sealing surfaces 218*a*, 218*b* and the tips 228. As depicted, the tips 228 of the rotor 220A seal with the circular sealing surface 218*a*, and the tips 228 of the rotor 220B sealed with the circular sealing surface 218*b*. The circular sealing surfaces 218*a* and 218*b* may intersect each other at a pair of cusps.

Figure 6:
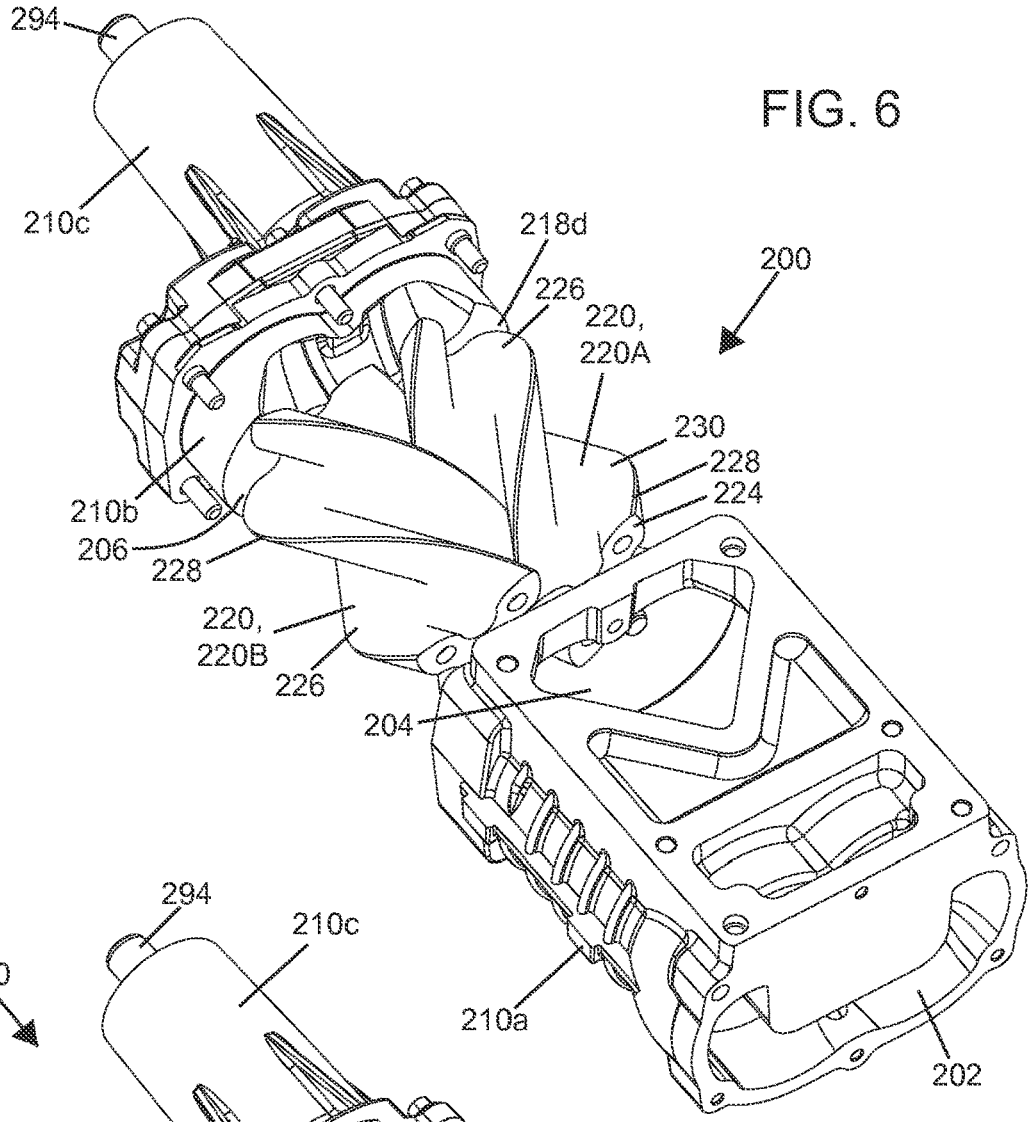
FIG. 6 is the perspective view of FIG. 5, but exploded.
Figure 5:
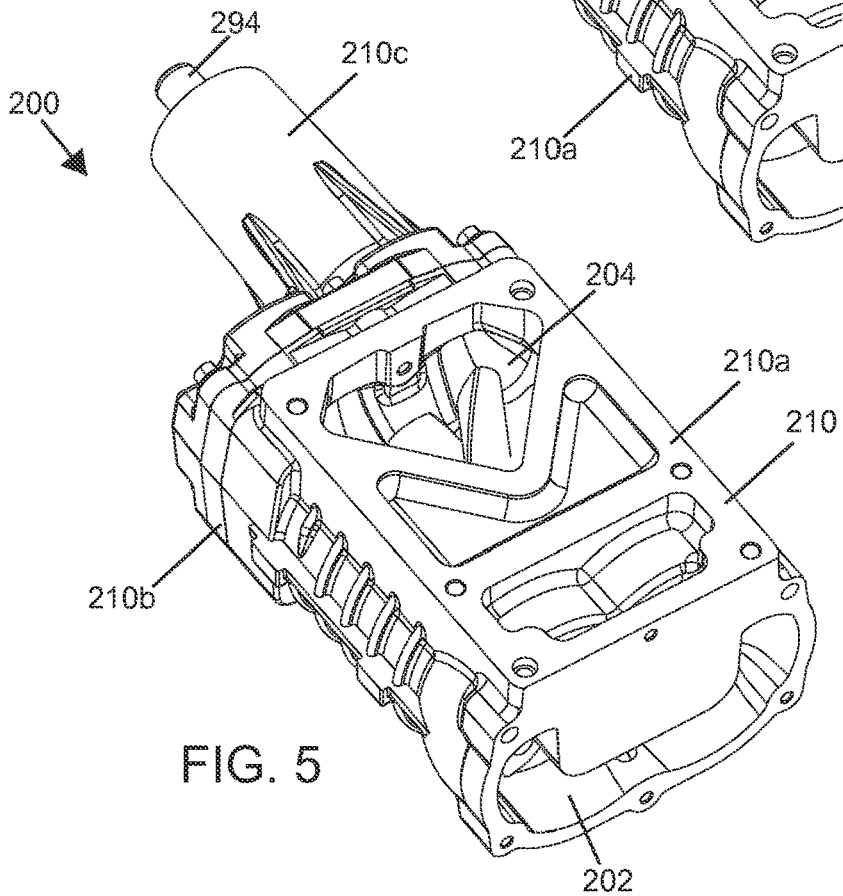
FIG. 5 is another perspective view of the Roots-type device of FIG. 1.

As depicted, the ends 222 of the lobes 230 of the rotors 220A, 220B may seal against a planar sealing surface 218*d* of the sealing surfaces 218 (see FIGS. 4 and 6). Likewise, the ends 224 of the lobes 230 may seal against a planar sealing surface 218*c* of the sealing surfaces 218 (see FIGS. 1 and 6). By sealing with each other, as used herein, it is understood that running clearances may exist between the sealing surfaces 218*c*, 218*d* and the ends 224, 222, respectively, and that leakage may occur between the sealing surfaces 218*c*, 218*d* and the ends 224, 222.

Turning now to FIGS. 8-12, a screw compressor is illustrated according to the principles of the present disclosure. In other embodiments, a screw expander may be subject to the same or similar treatment and/or finishing techniques described herein. As illustrated at FIGS. 8-12, a screw compressor 1200 includes an inlet 1202 and an outlet 1204. In operation on an internal combustion engine, air is drawn through the inlet 1202 and pumped from the inlet 1202 to the outlet 1204. As a displacement of the screw compressor 1200 may exceed a displacement of the internal combustion engine and/or as compression may be imposed on a working fluid within the screw compressor 1200, a pressure at the outlet 1204 may be greater than a pressure at the inlet 1202. The screw compressor 1200 may thereby compress air or an air-fuel mixture that it delivers to the internal combustion engine. As mentioned above, an amount of compression of the air may be referred to as a pressure ratio.

Figure 9:
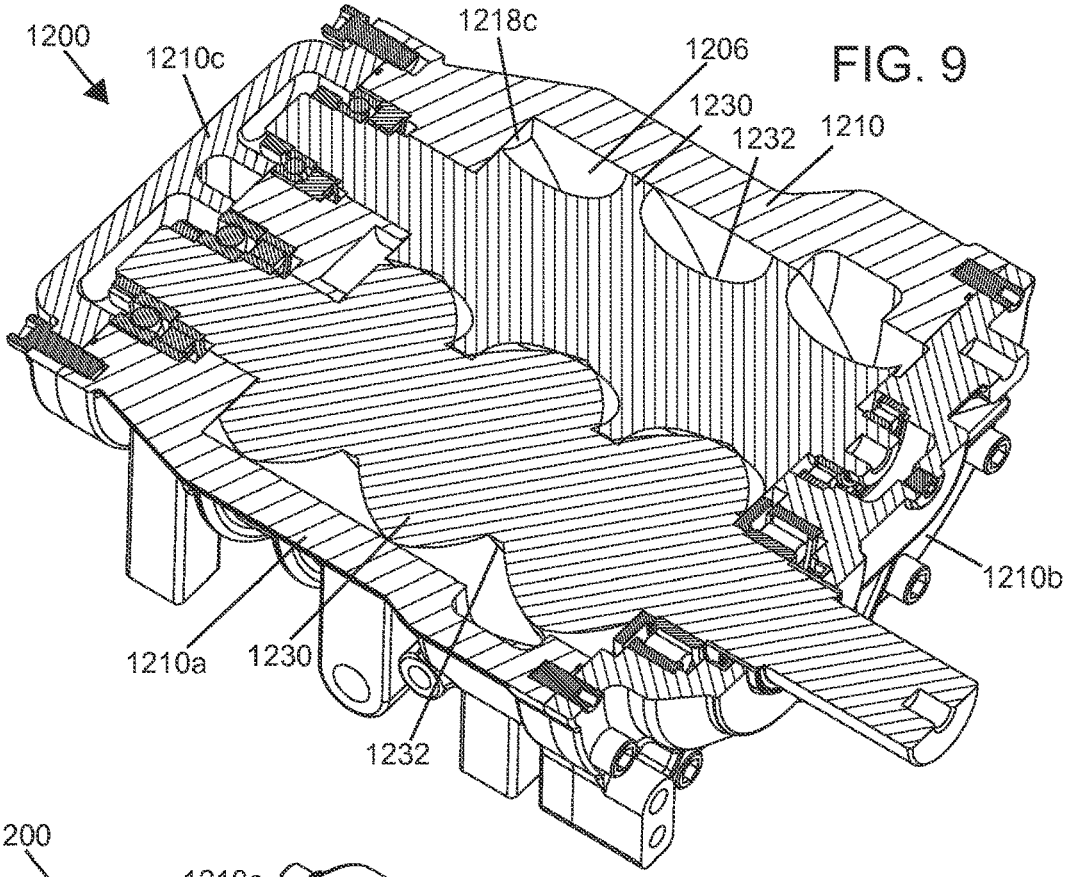
FIG. 9 is the perspective view of FIG. 8, but with a cut-away taken through center-lines of rotors of the screw compressor.
Figure 8:
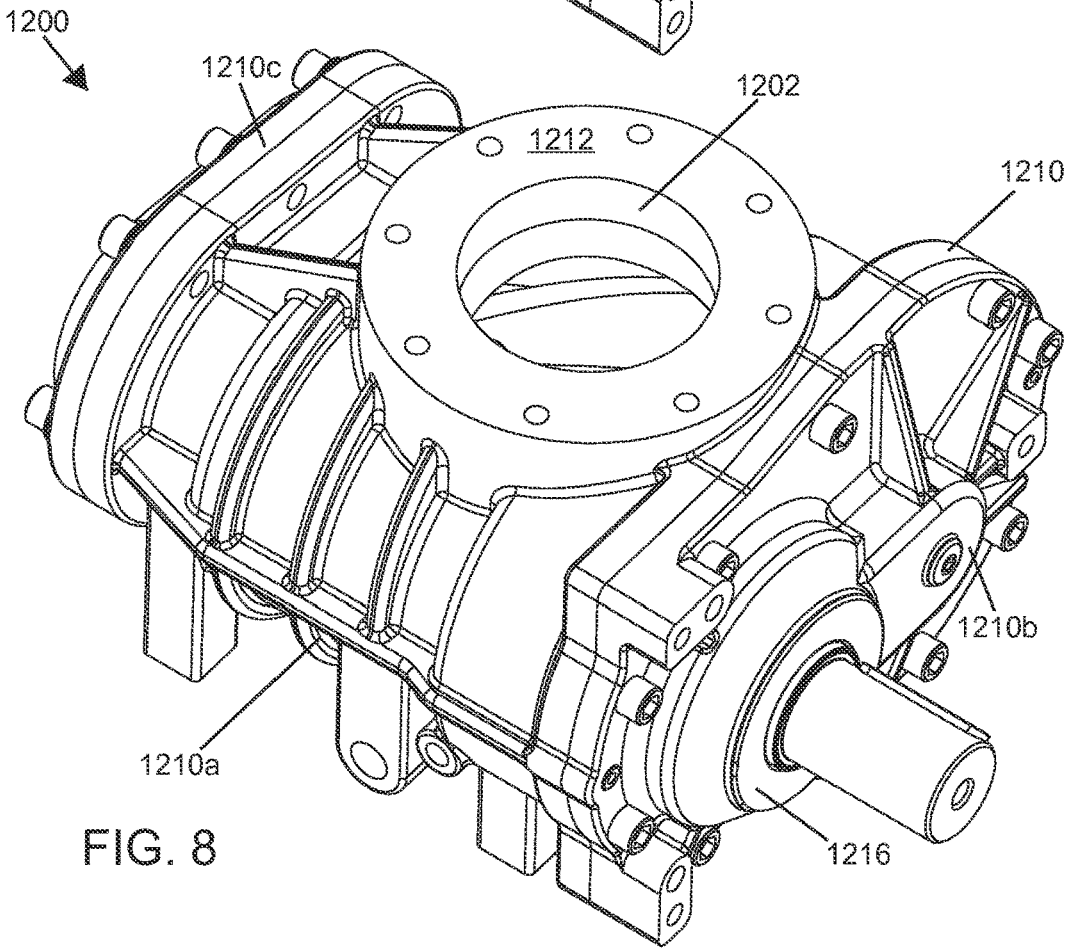
FIG. 8 is a perspective view of a screw compressor finished with a post-assembly coating system, similar to the post-assembly coating system of FIG. 1, according to the principles of the present disclosure.

The screw compressor 1200 further includes a set of rotors 1220. The set of rotors 1220 includes a first rotor 1220A and a second rotor 1220B. In the depicted embodiment, the first rotor 1220A is a male rotor, and the second rotor 1220B is a female rotor. As illustrated at FIG. 9, a drive shaft may coaxially align with a rotor shaft of the rotor 1220A. The rotor 1220B may be powered by a gear set or directly by the rotor 1220A. The rotors 1220A, 1220B include a plurality of lobes 1230 and valleys 1232. Each of the lobes 1230 further includes a tip 1228 (see FIG. 12). As illustrated, the lobes 1230 and the valleys 1232 extend along a helical path. As depicted, the lobes 1230 and the valleys 1232 define a screw surface 1226. The lobes 1230 and the valleys 1232 of the rotors 1220A, 1220B substantially extend between a first end 1222 and a second end 1224 (see FIGS. 11 and 12).

The screw compressor 1200 further includes a housing assembly 1210. As depicted, the housing assembly 1210 includes a main housing 1210*a*, a first end cap portion 1210*b*, and a second end cap portion 1210*c*. The housing assembly 1210 defines the inlet 1202 and the outlet 1204. The housing assembly 1210 includes an input end 1212 and an output end 1214 (see FIGS. 8 and 10). As depicted, the input end 1212 and the output end 1214 are substantially parallel to each other. In other embodiments, the input end 1212 and the output end 1214 may be substantially perpendicular to each other. In still other embodiments, the input end 1212 and the output end 1214 may be arranged at an angle with respect to each other. As depicted, the housing assembly 1210 further includes a drive end 1216 (see FIG. 8). As depicted, the rotor shafts generally longitudinally extend parallel to the input end 1212 and the output end 1214 and exit perpendicular to the drive end 1216 of the housing assembly 1210.

Figure 11:
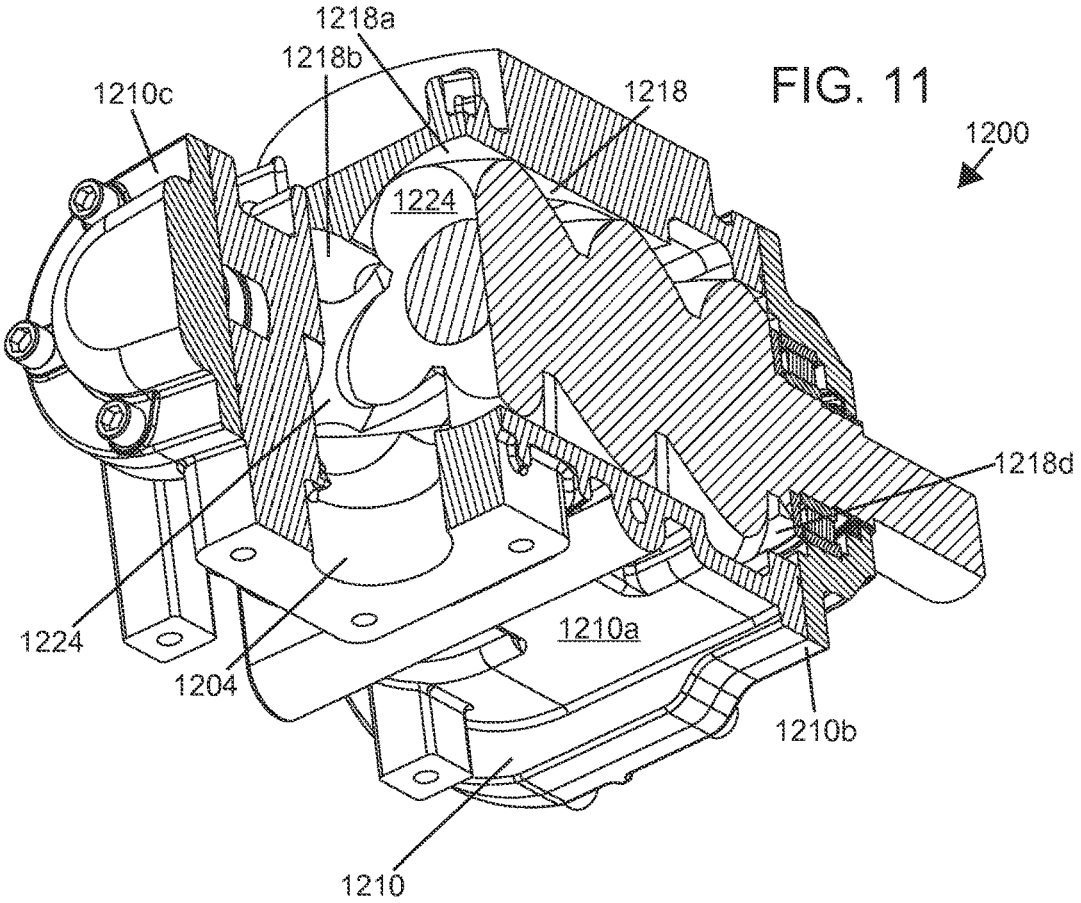
FIG. 11 is the perspective view of FIG. 10, but with a first cut-away taken through an exhaust port of the screw compressor and a second cut-away taken through a rotor and a housing of the screw compressor.
Figure 10:
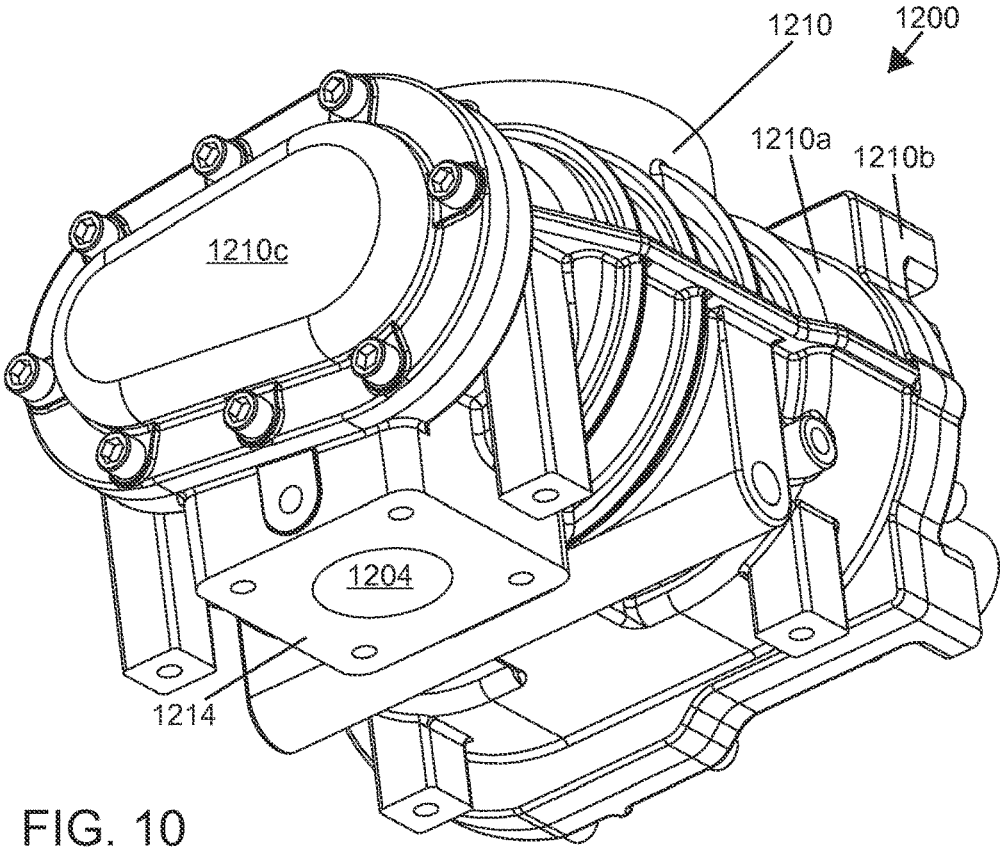
FIG. 10 is another perspective view of the screw compressor of FIG. 8.
Figure 12:
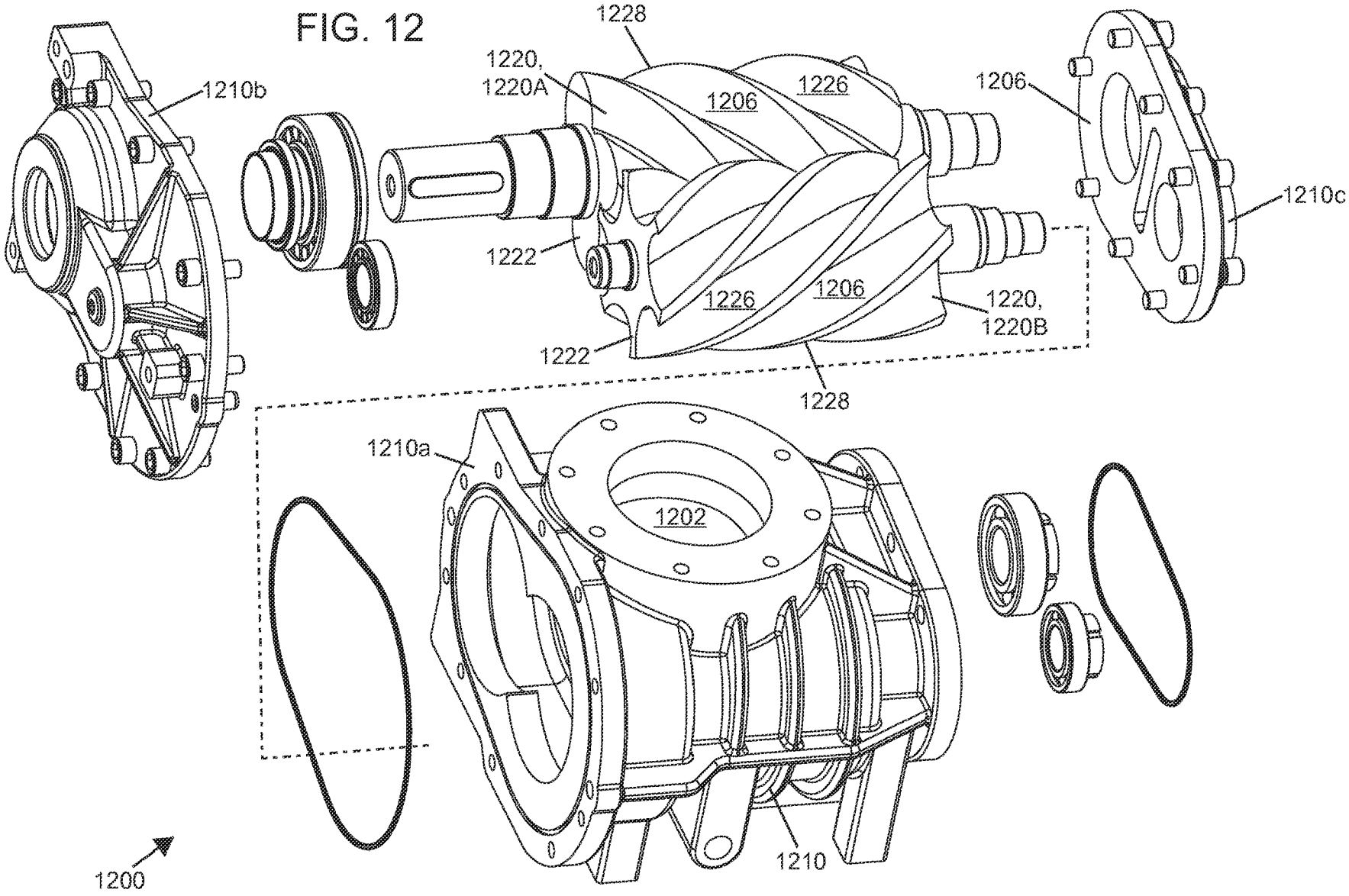
FIG. 12 is an exploded perspective view of the screw compressor of FIG. 8.

The housing assembly 1210 includes a set of sealing surfaces 1218 (see FIG. 11). In the depicted embodiment, the main housing 1210*a* of the housing assembly 1210 defines sealing surfaces 1218*a*, 1218*b* of the sealing surfaces 1218 that seal with the tips 1228 of the rotors 1220A, 1220B when they are adjacent to each other. By sealing with each other, as used herein, it is understood that running clearances may exist between the sealing surfaces 1218*a*, 1218*b* and the tips 1228, and that leakage may occur between the sealing surfaces 1218*a*, 1218*b* and the tips 1228. As depicted, the tips 1228 of the rotor 1220A seal with the circular sealing surface 1218*a*, and the tips 1228 of the rotor 1220B sealed with the circular sealing surface 1218*b*. The circular sealing surfaces 1218*a* and 1218*b* may intersect each other at a pair of cusps.

As depicted, the ends 1222 of the lobes 1230 of the rotors 1220A, 1220B may seal against a planar sealing surface 1218*d* of the sealing surfaces 1218 (see FIG. 11). Likewise, the ends 1224 of the lobes 1230 may seal against a planar sealing surface 1218*c* of the sealing surfaces 1218 (see FIG. 9). By sealing with each other, as used herein, it is understood that running clearances may exist between the sealing surfaces 1218*c*, 1218*d* and the ends 1224, 1222, respectively, and that leakage may occur between the sealing surfaces 1218*c*, 1218*d* and the ends 1224, 1222.

As illustrated at FIGS. 4, 6, 9, 11, and 12, the lobes 230, 1230 and the valleys 232, 1232 of the rotors 220A, 220B, 1220A, 1220B intermesh with and seal with each other, respectively. By sealing with each other, as used herein, it is understood that running clearances may exist between the lobes 230, 1230, including the tips 228, 1228 and the valleys 232, 1232 of the opposite rotor 220B, 220A, 1220A, 1220B, and that leakage may occur between the lobes 230, 1230, including the tips 228, 1228 and the corresponding valleys 232, 1232. As the rotors 220A, 220B, 1220A, 1220B rotate, the screw surfaces 226, 1226 and the tips 228, 1228 move in and out of intermeshing with the screw surfaces 226, 1226, and the tips 228, 1228 of the opposing rotor 220B, 220A. 1220A, 1220B and the tips 228, 1228 transition to sealing with the corresponding circular sealing surfaces 218*a*, 218*b*, 1218*a*, 1218*b*.

As depicted, an inlet volume 240 is defined by the circular sealing surface 218*a*, 218*b*, 1218*a*, 1218*b*, the planar sealing surface 218*c*, 1218*c*, and the screw surfaces 226, 1226, respectively. As defined herein, the inlet volume 240 is open to the inlet 202, 1202. Upon the rotors 220A, 220B, 1220A, 1220B rotating, portions of air within the supercharger 200 or the screw compressor 1200 become closed off from the inlet 202, 1202 and thereby are transferred from the inlet volume 240 to a transfer volume 242. The transfer volume 242 is closed off from both the inlet 202, 1202 and the outlet 204, 1204. As the rotors 220A, 220B, 1220A, 1220B further rotate, portions of air within the supercharger 200 or the screw compressor 1200 that were part of the transfer volume 242 are open to the outlet 204, 1204 and thereby become part of an outlet volume 244. In this way, air is moved through the supercharger 200 or the screw compressor 1200 by transferring through the inlet 202, 1202 and becoming part of the inlet volume 240, passing from the inlet volume 240 to the transfer volume 242, and further passing from the transfer volume 242 to the outlet volume 244. As the pressure at the outlet 204, 1204 is typically higher than the pressure at the inlet 202, 1202, air (or other gas) within the outlet volume 244 is urged to leak to the transfer volume 242, and air within the transfer volume 242 may be urged to leak to the inlet volume 240.

According to the principles of the present disclosure, clearances between the tips 228, 1228 of the rotor 220A, 1220A and the circular sealing surface 218*a*, 1218*a*, clearances between the tips 228, 1228 of the rotor 220B, 1220B and the circular sealing surface 218*b*, 1218*b*, clearances between the end 222, 1222 of the lobes 230, 1230 and the planar sealing surface 218*d*, 1218*d*, clearances between the end 224, 1224 of the lobes 230, 1230 and the planar sealing surface 218*c*. 1218*c*, and clearances between the intermeshing lobes 230 1230 and valleys 232, 1232 of the rotors 220A, 220B, 1220A, 12208 are reduced and thereby leakage within the supercharger 200 and/or the screw compressor 1200 is reduced.

In the embodiment depicted at FIG. 1, an application assembly 100 is formed by assembling the supercharger 200 to application hardware 300. The application hardware 300 may include a holding fixture 400 to which the supercharger 200 may be mounted. As depicted, the holding fixture 400 is holding the supercharger 200 with the axes of the rotors 220A, 220B extending in a horizontal plane. In other embodiments, the holding fixture 400 may hold the supercharger 200 such that the axes of the rotors 220A, 220B extend horizontally but a plane that includes both of the axes extends vertically. In still other embodiments, the holding fixture 400 may hold the supercharger 200 such that the axes of the rotors 220A, 220B are each aligned vertically. In yet other embodiments, the holding fixture 400 may hold the supercharger 200 in other orientations. As depicted, a mounting plate 450 may be included between the holding fixture 400 and the housing assembly 210 of the supercharger 200. As depicted, the holding fixture includes a passage 402, and the mounting plate 450 includes a passage 452 that substantially aligns with the outlet 204 of the supercharger 200. In other embodiments, the holding fixture 400 may be arranged such that the passage 402 and/or the passage 252 align with the inlet 202. As depicted, the holding fixture 400 further holds outlet side hardware 500 of the application hardware 300. In other embodiments, the outlet side hardware 500 may mount directly to the outlet 204 of the supercharger 200.

In the embodiment depicted at FIG. 2, an application assembly 100' is formed by assembling certain parts of the supercharger 200 to the application hardware 300. In the depicted embodiments, the application assembly 100' is similar to the application assembly 100, except the input power portion 210*c* of the housing assembly 210, the drive shaft 294, a drive pulley 292, and other parts of a drive assembly 290 are removed to provide access to the rotor shafts 280. In particular, by removing the portion 210*c* of the housing assembly 210, a first end 282 of each of the rotor shafts 280 is exposed. In other embodiments, provisions may be made to expose a second end 284 of each of the rotor shafts 280. Removing the portion 210*c* of the housing assembly 210 may also expose the gear set 286 and interfere with a lubrication system that otherwise lubricates the gear set 286. However, a temporary lubrication system 800 with a lubrication nozzle 802 may be directed at the gear set 286 to provide lubrication.

An application assembly, similar to the application assemblies 100, 100', may be formed by assembling the screw compressor 1200 to application hardware similar to or the same as the application hardware 300. Furthermore, an application assembly, similar to the application assemblies 100, 100', may be formed by assembling a twin rotor device to application hardware similar to or the same as the application hardware 300.

The outlet side hardware 500 may include a coating material collector 520; a flow device 530; a heat exchanger 540; a contoured flow passage 550; and/or flow control, instrument, and/or material injection/recovery equipment 560.

As schematically depicted, the equipment 560 is arranged in a housing with a first port 562 and a second port 564. The contoured flow passage 550 includes a first port 552 and a second port 554. A passage 556 connects the first port 552 to the second port 554. As depicted, the first port 552 is mounted to the passage 402 of the holding fixture 400. In other embodiments, the contoured flow passage 550 may connect directly to the outlet 204, 1204 of the supercharger 200, the screw compressor 1200, or other twin rotor device. The second port 554 of the contoured flow passage 550 may be fluidly connected to the first port 562 of the housing of the equipment 560.

The application hardware 300 may further include inlet side hardware 600. As depicted, the inlet side hardware 600 may mount directly to the inlet 202, 1202 of the supercharger 200, the screw compressor 1200, or other twin rotor device. In other embodiments, the holding fixture 400 holds the inlet side hardware 600 of the application hardware 300. The inlet side hardware 600 may include a material dispenser 610; a flow device 630; a heat exchanger 640; a contoured flow passage 650; and/or flow control, instrument, and/or material injection/recovery equipment 660.

As schematically depicted, the equipment 660 is arranged in a housing with a first port 662 and a second port 664. The contoured flow passage 650 includes a first port 652 and a second port 654. A passage 656 connects the first port 652 to the second port 654. As depicted, the first port 652 is mounted directly to the inlet 202, 1202 of the supercharger 200, the screw compressor 1200, or other twin rotor device. In other embodiments, the contoured flow passage 650 may connect to the passage 402 of the holding fixture 400. The second port 654 of the contoured flow passage 650 may be fluidly connected to the first port 662 of the housing of the equipment 660.

In alternative embodiments, a material dispenser 510 may be included with the outlet side hardware 500, and/or a material collector 620 may be included with the inlet side hardware 600 (see FIG. 2).

In certain embodiments, a coating material 102 is entrained by a carrier material 104 (e.g., air, nitrogen, argon, etc.) by the material dispenser 510 or the material dispenser 610 (see FIGS. 1 and 2). If the coating material 102 is supplied by the material dispenser 510, the supercharger 200, the screw compressor 1200, or other twin rotor device is run in reverse and thereby the coating material 102, entrained in the carrier material 104, is moved first into the outlet 204, 1204 of the supercharger 200, the screw compressor 1200, or other twin rotor device and backward through the supercharger 200, the screw compressor 1200, or other twin rotor device toward the inlet 202, 1202. If the coating material 102 is supplied by the material dispenser 610, the supercharger 200, the screw compressor 1200, or other twin rotor device is run in a normal direction and thereby the coating material 102, entrained in the carrier material 104, is moved first into the inlet 202, 1202 of the supercharger 200, the screw compressor 1200, or other twin rotor device and forward through the supercharger 200, the screw compressor 1200, or other twin rotor device toward the outlet 204, 1204.

In certain backward running embodiments, excess coating material of the coating material 102 that passes through the supercharger 200, the screw compressor 1200, or other twin rotor device without adhering may be collected by the material collector 620 within the housing of the inlet side hardware 600. Likewise, in certain forward running embodiments, excess coating material of the coating material 102 that passes through the supercharger 200, the screw compressor 1200, or other twin rotor device without adhering may be collected by the material collector 520 within the housing of the outlet side hardware 500.

In certain embodiments, recirculation plumbing 310 is connected between the second port 664 of the housing of the equipment 660 and the second port 564 of the housing of the equipment 560. In particular, a first port 312 of the recirculation plumbing 310 may be connected to the second port 664 of the housing of the equipment 660, and a second port 314 of the recirculation plumbing 310 may be connected to the second port 564 of the housing of the equipment 560. In certain embodiments, the carrier material 104 is recirculated. In certain embodiments, the carrier material 104 along with unused coating material of the coating material 102 may be recirculated. In still other embodiments, the recirculation plumbing 310 is not used, and instead fresh coating material 102 and/or fresh carrier material 104 is used.

As the coating material 102 passes through the supercharger 200, the screw compressor 1200, or other twin rotor device, a portion of the coating material 102 will adhere to the sealing surfaces 218, 1218 of the housing assembly 210, 1210 and the ends 222, 224, 1222, 1224, screw surfaces 226, 1226, and tips 228, 1228 of the rotors 220A, 220B, 1220A, 1220B. The clearances between these surfaces 218, 222, 224, 226, 228, 1218, 1222, 1224, 1226, 1228 may create leakage between the adjoining surfaces 218, 222, 224, 226, 228, 1218, 1222, 1224, 1226, 1228. Such leakages will encourage the coating material 102 and/or the carrier material 104 to pass through the clearances and deposit the coating material 102 on the surfaces 218, 222, 224, 226, 228, 1218, 1222, 1224, 1226, 1228. As the coating material 102 collects on the surfaces 218, 222, 224, 226, 228, 1218, 1222, 1224, 1226, 1228, a coating 206, 1206 is formed on the surfaces 218, 222, 224, 226, 228, 1218, 1222, 1224, 1226, 1228. As will be described hereinafter, the coating 206, 1206 may cure into a solidified coating surface 206, 1206. The coating 206, 1206 may form a permanent or a semi-permanent coating on the surfaces 218, 222, 224, 226, 228, 1218, 1222, 1224, 1226, 1228.

In certain embodiments, the coating 206, 1206 is cured while the rotors 220A, 220B, 1220A, 1220B are spinning. In certain embodiments, the coating 206, 1206 may further wear-in and thereby further finish itself over a wear-in period. In certain embodiments, the coating material 102 and/or the carrier material 104 may be run through the supercharger 200, the screw compressor 1200, or other twin rotor device in a first direction from the inlet 202, 1202 to the outlet 204, 1204 and additional material may be applied by running the supercharger 200, the screw compressor 1200, or other twin rotor device in reverse with the coating material 102 and/or the carrier material 104 generally passing from the outlet 204, 1204 to the inlet 202, 1202. In certain embodiments, the coating material 102 may be first applied by running the supercharger 200, the screw compressor 1200, or other twin rotor device in the reverse direction.

Turning again to FIGS. 1 and 2, a control system 900 may be used in applying the coating material 102, emitting the carrier material 104, and/or curing the coating material 102 into the coating 206, 1206. As depicted at FIGS. 1 and 2, the control system 900 may include and/or interface with one or more flow monitors 910 (i.e., flow sensors), pressure monitors 920 (i.e., pressure sensors), temperature monitors 930 (i.e., temperature sensors), state sensors 940, tachometers 950, rotary inputs 960 (e.g., motors, speed controllers, torque controllers, etc.), electrostatic generators 700, etc. As mentioned above, the supercharger 200, the screw compressor 1200, or other twin rotor device may be run in the forward direction or in the reverse direction. The various components of the control system 900 and equipment 560, 660 may be arranged to match the direction chosen to run the supercharger 200, the screw compressor 1200, or other twin rotor device when applying the coating material 102. The supercharger 200, the screw compressor 1200, or other twin rotor device may also be run in both the forward and the reverse rotational directions when applying the coating material 102 to form the coating 206, 1206.

As depicted, various sensors and application hardware are schematically illustrated in the outlet equipment group 560 and the inlet equipment group 660. In certain embodiments, the various sensors and application equipment may only be located in the outlet equipment group 560 or the inlet equipment group 660. Certain equipment and/or certain sensors may be located in both the outlet equipment group 560 and the inlet equipment group 660. In particular, the flow monitor 910 may include an outlet flow monitor 9100*o* and an inlet flow monitor 910*i*. Likewise, the pressure monitor 920 may include an outlet pressure monitor 920*o* and an inlet pressure monitor 920*i*. The pressure monitors

920*o*, 920*i* may be used to measure a differential pressure across the outlet 204, 1204 and the inlet 202, 1202 of the supercharger 200, the screw compressor 1200, or other twin rotor device. The temperature monitor 930 may include an outlet temperature monitor 930*o* and an inlet temperature monitor 930*i*. The state sensor 940 may include an outlet state sensor 940*o* and an inlet state sensor 940*i*. The state sensors 940, 940*o*, 940*i* may be used to measure an amount of the coating material 102 and/or the carrier material 104 and a percentage (e.g., by weight) of the coating material 102 and/or the carrier material 104 that are in solid, liquid, and/or gaseous form.

The control system 900 may send commands to the flow device 530 and/or the flow device 630 and thereby generate differential pressure across the inlet 202, 1202 and the outlet 204, 1204 of the supercharger 200, the screw compressor 1200, or other twin rotor device. The control system may further initiate coating material 102 and/or carrier material 104 being dispensed from the material dispenser 510 and/or the material dispenser 610.

By monitoring a rotational speed of the rotors 220A, 220B, 1220A, 1220B with the tachometer 950, the development of the coating 206, 1206 may be estimated. In particular, as the coating material 102 is converted into the coating 206, 1206, the various clearances within the supercharger 200, the screw compressor 1200, or other twin rotor device may be reduced and the leakage across the clearances may be reduced. Under a given differential pressure generated by the flow device 530 and/or the flow device 630, the speed of the rotors 220A, 220B, 1220A, 1220B may increase with decreasing internal clearances. By monitoring the increase in the rotor speed, the condition of the coating 206, 1206 may be estimated. Upon a certain condition of the coating material 206, 1206 being reached, the injection of the coating material 102 and/or the carrier material 104 may be suspended. As mentioned above, the supercharger 200, the screw compressor 1200, or other twin rotor device may continue to run after the suspension of the coating material 102 and/or the carrier material 104. In particular, the coating 206, 1206 may be allowed to cure while the supercharger 200, the screw compressor 1200, or other twin rotor device is running (i.e., the rotors 220A, 220B, 1220A, 1220B are spinning).

In certain embodiments, the rotary input 960 may be connected to the rotors 220A, 1220A and/or 220B, 1220B directly or indirectly. As illustrated at FIG. 1, the rotary input 960 is connected to the drive pulley 292 by a drive belt 962. The rotary input 960, under the control of the control system 900, may apply a resisting torque that slows down (i.e., retards) the rotation of the rotors 220A, 220B, 1220A, 1220B. The torque supplied by the rotary input 960 may vary as the coating material 102 is applied to form the coating 206, 1206. The rotary input 960 may be set to maintain a given speed of the rotors 220A, 220B, 1220A, 1220B while allowing the drag torque (i.e., the resisting torque) to vary. In general, the drag torque will be increased as the coating 206, 1206 is formed and the differential pressure across the inlet 202, 1202 and the outlet 204, 1204 is maintained. Feedback from the rotary input 960 may thereby be used to indicate when the coating 206, 1206 has reached various states including a state where emission of the coating material 102 is suspended.

In certain embodiments, the rotary input 960 may drive the supercharger 200, the screw compressor 1200, or other twin rotor device and induce flow through the supercharger 200, the screw compressor 1200, or other twin rotor device and create a pressure differential across the supercharger 200, the screw compressor 1200, or other twin rotor device (i.e., across the inlet 202, 1202 and the outlet 204, 1204). The flow created by the rotary input 960 when driving the supercharger 200, the screw compressor 1200, or other twin rotor device may entrain the coating material 102 and/or the carrier material 104 and thereby form the coating 206, 1206. The coating 206 may reduce internal clearances and thereby result in an increase in the pressure differential across the supercharger 200, the screw compressor 1200, or other twin rotor device. By monitoring the pressure differential across the supercharger 200, the screw compressor 1200, or other twin rotor device, the state of the coating 206, 1206 may be estimated. When a state of the coating 206, 1206 reaches a predetermined level, further application of the coating material 102 and/or the carrier material 104 may be suspended.

In addition to the aforementioned parameters of rotor rotational speed, rotor retarding torque, and pressure differential being used as feedback to monitor the state of the coating 206, 1206, leakage across the supercharger 200, the screw compressor 1200, or other twin rotor device may also be measured and/or estimated. The leakage may likewise be used to suspend further application of the coating material 102 and/or the carrier material 104 when a state of the coating 206, 1206 reaches a predetermined level.

As the coating material 102 and/or the carrier material 104 flow through the supercharger 200, the screw compressor 1200, or other twin rotor device, the coating material 102 and/or the carrier material 104 will generally follow a path of least resistance. The coating material 102 and/or the carrier material 104 will therefore seek out larger clearances between the surfaces 218, 222, 224, 226, 228, 1218, 1222, 1224, 1226, 1228 and pass through and fill the larger clearances first. In certain embodiments, as the coating material 102 and/or the carrier material 104 flow through the clearances, thermodynamic properties of the coating material 102 and/or the carrier material 104 may change and thereby assist in depositing the coating material 102 as the coating 206, 1206. In certain embodiments, leakage across the clearances produces heat from work being provided by the air, the coating material 102, and/or the carrier material 104 flowing across a pressure drop. The heat from the leakage may be used to assist in depositing the coating material 102 as the coating 206, 1206.

The supercharger 200, the screw compressor 1200, or other twin rotor device may be run without the coating material 102 and/or without the carrier material 104 for a given period to heat the supercharger 200, the screw compressor 1200, or other twin rotor device. Upon a desired temperature profile of the supercharger 200, the screw compressor 1200, or other twin rotor device being reached, the coating material 102 and/or the carrier material 104 may be applied.

As mentioned above, the coating material 102 may include powder coating components or other components that may be activated or otherwise affected by application of electricity (e.g., electric charge). As illustrated at FIG. 2, the electrostatic generator 700 is connected to one or both of the rotor shafts 280 by a conductive lead 702 (e.g., a brush). A conductive lead may also be connected to one or more parts of the housing assembly 210. The rotor shaft 280 and the rotors 220A, 220B, 1220A, 1220B may be made of a conductive material and thereby charge the surfaces 218, 220, 224, 226, 228, 1218, 1222, 1224, 1226, 1228 with electricity (e.g., static electricity). Such static electricity may draw the coating material 102 to the surfaces 218, 222, 224, 226, 228, 1218, 1222, 1224, 1226, 1228 and thereby assist in converting the coating material 102 to the coating 206, 1206. In certain embodiments, the coating material 102 and/or the carrier material 104 may be electrically charged.

The carrier material 104 may include a low flash point solvent. The coating material 102 may be carried by the carrier material 104, and the carrier material 104 may evaporate prior to the coating material 102 reaching the surfaces 218, 222, 224, 226, 228, 1218, 1222, 1224, 1226, 1228. The coating material 102 may thereby be applied to the surfaces 218, 222, 224, 226, 228, 1218, 1222, 1224, 1226, 1228 dry.

Figure 7:
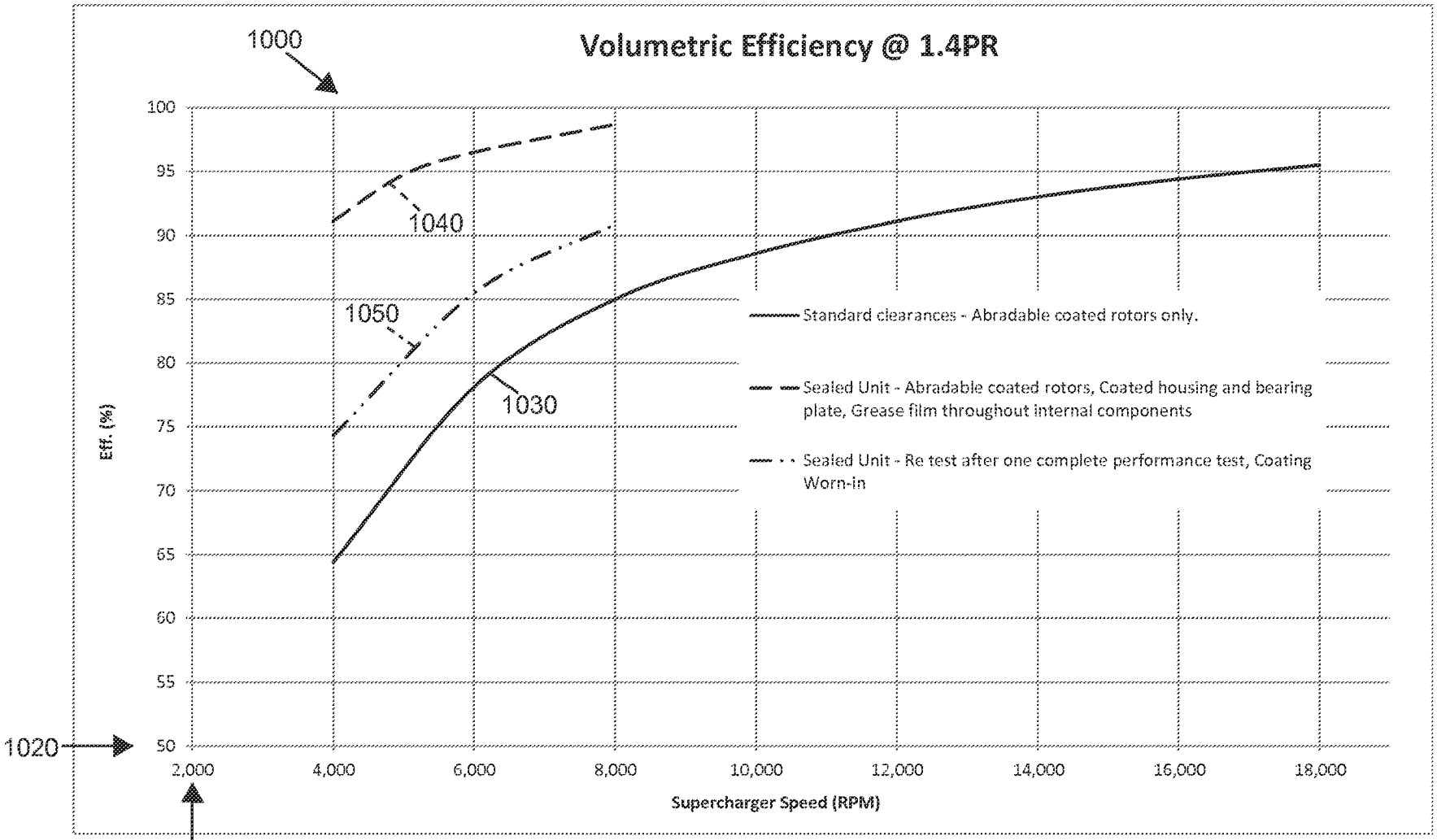
FIG. 7 is a graph illustrating performance characteristics of a Roots-type device and improvements in the performance characteristics that may result upon applying a coating to internal features of the Roots-type device according to the principles of the present disclosure.

Turning now to FIG. 7, a graph 1000 showing experimental results of applying a particular coating material 102 to a particular supercharger 200 is illustrated. In particular, the graph 1000 illustrates a relationship between a baseline performance 1030 of the supercharger 200 and an enhanced performance achieved with the coating material 102 freshly applied as the coating 206, as illustrated at curve 1040. A curve 1050 illustrates a performance of the coating 206 after the coating 206 has worn-in. The graph 1000 plots the rotational speed of the rotors 220A, 220B along an X-axis 1020 and plots a volumetric efficiency 1010 of the supercharger 200 along a Y-axis 1010. As can be seen, initial application of the coating material 102 increased the volumetric efficiency of the supercharger 200 between the speeds of 4,000 and 8,000 revolutions per minute. The experimental coating 206 was applied via a spray-on dry graphite material 102. The experiment illustrates that the coating 206 of the coating material 102 was effective in increasing the volumetric efficiency of the supercharger 200.

In various embodiments, twin rotor devices with coatings such as the coatings 206, 1206, described above, may be used to pump compressible and/or non-compressible fluids. In various embodiments, twin rotor devices with coatings such as the coatings 206, 1206, described above, may be used to extract shaft power from compressible and/or non-compressible fluids.

From the forgoing detailed description, it will be evident that modifications and variations can be made without departing from the spirit and scope of the disclosure.

What is claimed is:

1. A method of treating a twin rotor device the method comprising:

providing the twin rotor device, the twin rotor device including a pair of rotors and a housing with an air inlet port and a compressed air outlet port, the rotors and the housing defining a set of working surfaces adapted to interface with each other;

providing a first coating material dispenser-collector and a second coating material dispenser-collector, each of the first and second coating material dispenser-collectors being configured to selectively dispense and collect a coating material;

fluidly connecting the first coating material dispenser-collector to cover the the air inlet port of the housing and connecting the second coating material dispenser-collector to cover the compressed air outlet port of the housing; and entraining the coating material in a carrier fluid with one of the first and second coating material dispenser-collectors by inducing a coating material to flow from either the air inlet port toward the compressed air outlet port of the housing or from the compressed air outlet port to the air inlet port of the housing, and thereby depositing at least some of the coating material as a coating on at least some of the working surfaces; and collecting undeposited coating material with the other of the first and second material dispenser-collectors.

2. The method of claim 1, further comprising:

applying a torque to at least one of the rotors thereby spinning the rotors and thereby inducing the coating material to flow from the an air inlet port toward the compressed air outlet port of the housing.

3. The method of claim 1, further comprising:

applying a pressure differential across the an air inlet port and the compressed air outlet port of the housing and thereby inducing the coating material to flow from the an air inlet port toward the compressed air outlet port of the housing.

4. The method of claim 3, wherein the pressure differential further spins the rotors.

5. The method of claim 1, further comprising:

measuring an operating parameter of the twin rotor device as the at least some of the coating material is deposited on the at least some of the working surfaces; and discontinuing the depositing of the at least some of the coating material upon the operating parameter reaching a predetermined value.

6. The method of claim 5, wherein the operating parameter is a rotational speed of at least one of the rotors.

7. The method of claim 5, wherein the operating parameter is a torque applied on at least one of the rotors.

8. The method of claim 5, wherein the operating parameter is a pressure differential value across the first port and the second port of the housing.

9. The method of claim 5, wherein the operating parameter is a net internal leakage of the twin rotor device.

10. The method of claim 1, wherein the twin rotor device is a Roots-type device.

11. The method of claim 1, wherein the twin rotor device is a screw-type device.

12. The method of claim 1, wherein the twin rotor device is adapted to pump a compressible fluid.

13. The method of claim 1, wherein the twin rotor device is adapted to pump a non-compressible fluid.

14. The method of claim 1, wherein the twin rotor device is adapted to extract shaft power from a compressible fluid.

15. The method of claim 1, wherein the twin rotor device is adapted to extract shaft power from a non-compressible fluid.

16. The method of claim 1, including continuously recirculating the undeposited coating material from the material collector to the material dispenser and delivering the undeposited coating material to the first port of the twin rotor device.

17. A method of treating a twin rotor device, the method comprising:

providing the twin rotor device, the twin rotor device including a pair of rotors and a housing with an air inlet port and a compressed air outlet port, the rotors and the housing defining a set of working surfaces adapted to interface with each other; and electrically grounding one or both of the housing and the pair of rotors;

inducing an electrostatic coating material to flow from either the air inlet port toward the compressed air outlet port of the housing or from the compressed air outlet ort to the air inlet port of the housing, and thereby depositing at least some of the electrostatic coating material as a coating on at least some of the working surfaces.

18. The method of claim 17, wherein the housing and the pair of rotors are oppositely charged.

* * * * *